US012782018B2

(12) United States Patent
Annamalai et al.

(10) Patent No.: US 12,782,018 B2
(45) Date of Patent: Nov. 3, 2026

(54) SYSTEM AND METHOD TO PREDICT ICE GRADIENT IN REFRIGERATION UNITS

(71) Applicant: Carrier Corporation, Palm Beach Gardens, FL (US)

(72) Inventors: Vinoth Kumar Annamalai, Chennai (IN); Prabhu Raja S V, Bangalore (IN); Somesh Bandari Gopalaiah, Bangalore (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 376 days.

(21) Appl. No.: 18/544,994

(22) Filed: Dec. 19, 2023

(65) Prior Publication Data

US 2024/0210083 A1 Jun. 27, 2024

Related U.S. Application Data

(60) Provisional application No. 63/476,481, filed on Dec. 21, 2022.

(51) Int. Cl.
*F25B 47/02* (2006.01)

(52) U.S. Cl.
CPC ..... *F25B 47/02* (2013.01); *F25B 2700/11* (2013.01)

(58) Field of Classification Search
CPC ..... F25B 47/02; F25B 2700/11
USPC ..... 62/140
See application file for complete search history.

(56) References Cited

U.S. PATENT DOCUMENTS

| | | | |
|---|---|---|---|
| 4,750,332 | A | 6/1988 | Jenski et al. |
| 9,032,751 | B2 | 5/2015 | Lacey et al. |
| 10,240,861 | B2 | 3/2019 | Sugar et al. |
| 10,901,373 | B2 | 1/2021 | Locke et al. |
| 10,935,309 | B2 | 3/2021 | Devi et al. |
| 10,965,489 | B2 | 3/2021 | Han et al. |

(Continued)

FOREIGN PATENT DOCUMENTS

| | | | | |
|---|---|---|---|---|
| CN | 106482408 A | * | 3/2017 | ..... F25B 47/00 |
| EP | 1180652 A1 | | 2/2002 | |

(Continued)

OTHER PUBLICATIONS

FOR1, Development Method Of Multi-region Frosting Pattern For Predicting Air Source Heat Pump Frosting Degree, 2017, Full Document (Year: 2017).*

(Continued)

*Primary Examiner* — Nael N Babaa
(74) *Attorney, Agent, or Firm* — Drew Folgmann

(57) ABSTRACT

A system and method for predicting ice gradient in refrigeration units is disclosed, comprising steps of capturing data pertaining to parameters of the refrigeration units, correlating the received parameters to generate characteristic features indicative of behaviour and performance of the one or more refrigeration units, generating events based on the generated characteristic features, identifying a frosting pattern associated with the refrigeration units by analyzing the generated events, determining a quantum of icing and a rate of ice formation in the refrigeration units based on the identified frosting pattern, and predicting ice gradient associated with the refrigeration units based on the determined quantum of icing and the rate of ice formation.

17 Claims, 12 Drawing Sheets

(56) References Cited

U.S. PATENT DOCUMENTS

| | | | |
|---|---|---|---|
| 11,187,446 | B2 | 11/2021 | Brady et al. |
| 2020/0210824 | A1 | 7/2020 | Poornaki et al. |
| 2021/0333039 | A1 | 10/2021 | Kang |

FOREIGN PATENT DOCUMENTS

| | | | |
|---|---|---|---|
| EP | 1725819 | B1 | 10/2017 |
| WO | 2020210083 | A1 | 10/2020 |

OTHER PUBLICATIONS

D. Datta and S. A. Tassou, "Frost Prediction on Evaporator Coils of Supermarket Display Cabinets Using Artificial Neural Networks", Department of Mechanical Engineering, Brunel University, Uxbridge, Middlesex UB8 3PH, D. Marriott, Safeway Stores PLC,6 Millington Road, Hayes, Middlesex UB3 4AY, 10 pages, n.d.
Extended European Search Report received for EP Application No. 23218762.5, mailed on Apr. 24, 2024, 12 Pages.
Mohit Yadav et al, "ODE—Augmented Training Improves Anomaly Detection in Sensor Data from Machines", arXiv.org, May 5, 2016 Cornell University Library, 201 Olin Library Cornell University Ithaca, NY 14853, 5 Pages, XP080699563.

* cited by examiner

SYSTEM AND METHOD TO PREDICT ICE GRADIENT IN REFRIGERATION UNITS

CROSS-REFERENCE TO RELATED APPLICATION

This patent application claims the benefit of U.S. Provisional Patent Application No. 63/476,481, filed on Dec. 21, 2022, which is incorporated by reference herein in its entirety.

BACKGROUND

This invention relates to the field of refrigeration systems, and more particularly, to a system and method to predict ice gradient and the impact of the ice gradient in refrigeration units.

Refrigeration units (systems) are operated continuously to maintain the temperature requirements. As the temperature of evaporators within the cabinet/room associated with the refrigeration units goes below the freezing temperature, water vapor in the cabinet/room condenses and freezes the evaporator surface to form frost. The presence of frost on the evaporator surface may deteriorate the performance of the refrigeration unit, impact food and products stored in the refrigeration unit, reduce the life span of the refrigeration unit, require high maintenance cost, and make the refrigeration unit inefficient.

There is, therefore, a need to provide a solution that predicts ice gradient (or trend frost formation) in refrigeration units for providing early warning and adequate time for action to mitigate the effect of frost formation.

SUMMARY

Described herein is a system to predict ice gradient in one or more refrigeration units. The system comprises a server in communication with the one or more refrigeration units. The server comprising a processor coupled to a memory storing instructions executable by the processor and configured to receive data pertaining to one or more parameters of the one or more refrigeration units, correlate the received parameters to generate one or more characteristic features indicative of behaviour and performance of one or more components of the one or more refrigeration units, generate one or more events based on the generated characteristic features, identify a frosting pattern associated with the one or more refrigeration units by analyzing the one or more events, determine a quantum of icing and a rate of ice formation in the one or more refrigeration units based on the identified frosting pattern for each of the one or more refrigeration units, and predict ice gradient associated with the one or more refrigeration units based on the determined quantum of icing and the rate of ice formation.

In one or more embodiments, the server is configured to generate and transmit a set of alert signals to the one or more refrigeration units and/or one or more mobile devices based on the predicted ice gradient.

In one or more embodiments, one or more mobile devices are in communication with the server and/or the one or more refrigeration units.

In one or more embodiments, the server is configured to classify the one or more generated events into a systematic event and a non-systematic event, and identify a frosting pattern associated with the one or more refrigeration units by analyzing the one or more non-systematic events.

In one or more embodiments, the server is configured with a machine learning module that is configured to update a database associated with the server with a set of data packets comprising one or more of the captured parameters, the generated characteristic features, the identified non-systematic events and corresponding predefined threshold values, the identified frosting pattern, the determined quantum of icing and rate of ice formation, and the predicted ice gradient; and train, based on the updated database, the server to predict the ice gradient of the one or more refrigeration units in real-time.

In one or more embodiments, the server is configured with an ancillary injection module to determine unavailable parameters associated with a set of refrigeration units among the one or more refrigeration units based on the available parameters associated with another set of refrigeration units among the one or more refrigeration units.

In one or more embodiments, the server is configured to identify the frosting pattern from the non-systematic events by normalizing the identified non-systematic events that are not associated with frosting, wherein the identification, normalization, and differentiation of the systematic events and the non-systematic events are achieved by continuous learning during the ice gradient prediction, and wherein the non-systematic events are analyzed based on a trend, a recent performance, and a quantum of variation of the corresponding non-systematic events.

In one or more embodiments, the server is in communication with a controller associated with the one or more refrigeration units, wherein the controller is configured to monitor and store the one or more parameters of the corresponding refrigeration units, and actuate and control the operation of a defrosting unit of the corresponding refrigeration unit based on the predicted ice gradient.

In one or more embodiments, when the predicted ice gradient exceeds a threshold value, the server is configured to transmit a set of alert signals to a defrosting unit of the one or more refrigeration units via the controller to enable defrosting of the corresponding refrigeration unit, wherein the threshold value is a dynamic value that is determined and updated by continuously learning during the ice gradient prediction.

Also described herein is a device configurable with one or more refrigeration units and operable to predict ice gradient and impact of the ice gradient in the one or more refrigeration units. The device comprises a processing unit adapted to be operatively coupled to the one or more refrigeration units. The processing unit comprising a processor coupled to a memory storing instructions executable by the processor and configured to capture data pertaining to one or more parameters of the one or more refrigeration units, correlate the captured parameters to generate one or more characteristic features indicative of behaviour and performance of one or more components of the one or more refrigeration units, generate one or more events based on the generated characteristic modules, differentiate the one or more generated events into a systematic event and a non-systematic event, identify frosting pattern of the one or more refrigeration units by analyzing the one or more non-systematic events, determine quantum of icing and rate of ice formation in the one or more refrigeration units based on the identified frosting pattern, and predict ice gradient and impact of the predicted ice gradient on the one or more refrigeration units based on the determined quantum of icing and the rate of ice formation.

In one or more embodiments, the device comprises a set of sensors to capture and monitor the one or more parameters of the one or more refrigeration units.

In one or more embodiments, the device is configured to transmit a set of control signals to a defrosting unit of the one or more refrigeration units to control defrosting of the corresponding refrigeration unit based on the predicted ice gradient.

Also described herein is a method to method for predicting ice gradient in one or more refrigeration units, the method comprising the steps of capturing data pertaining to one or more parameters of the one or more refrigeration units, correlating the received parameters to generate one or more characteristic features indicative of behaviour and performance of one or more components of the one or more refrigeration units, generating one or more events based on the generated characteristic modules, identifying frosting pattern of the one or more refrigeration units by analyzing the one or more events, determining quantum of icing and rate of ice formation in the one or more refrigeration units based on the identified frosting pattern, and predicting ice gradient and an impact of the predicted ice gradient on the one or more refrigeration units based on the determined quantum of icing and the rate of ice formation.

In one or more embodiments, the method comprises the step of transmitting a set of control signals to a defrosting unit of the one or more refrigeration units to control defrosting of the corresponding refrigeration unit based on the predicted ice gradient.

In one or more embodiments, the method comprises the step of determining unavailable parameters associated with a set of refrigeration units among the one or more refrigeration units based on the available parameters captured from other set of refrigeration units among the one or more refrigeration units.

In one or more embodiments, the method comprises the steps of classifying the one or more generated events into a systematic event and a non-systematic event, and identifying a frosting pattern associated with the one or more refrigeration units by analyzing the one or more non-systematic events.

In one or more embodiments, the method comprises the step of normalizing the identified non-systematic events that are not associated with frosting to identify the frosting pattern from the non-systematic events, and wherein the non-systematic events are analyzed based on a trend, a recent performance, and a quantum of variation of the corresponding non-systematic events.

In one or more embodiments, when the predicted ice gradient exceeds a threshold value, the method comprises the step of transmitting a set of alert signals to the defrosting unit of the one or more refrigeration units to enable defrosting of the corresponding refrigeration unit, wherein the threshold value is a dynamic value that is determined and updated by continuously learning during the ice gradient prediction.

In one or more embodiments, the one or more parameters comprise dynamic parameters comprising one or more of evaporator surface temperature, return air temperature, defrost status, and expansion valve opening degree; and static parameters comprising one or more of type of controller used in the corresponding refrigeration unit; attributes comprising type, and cooling type of the one or more refrigeration unit; and operational policies associated with the one or more refrigeration unit.

In one or more embodiments, one or more characteristic features comprises one or more of defrost characteristics, heat exchange characteristics, return air temperature characteristics, and expansion valve characteristics.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

Figure 1:
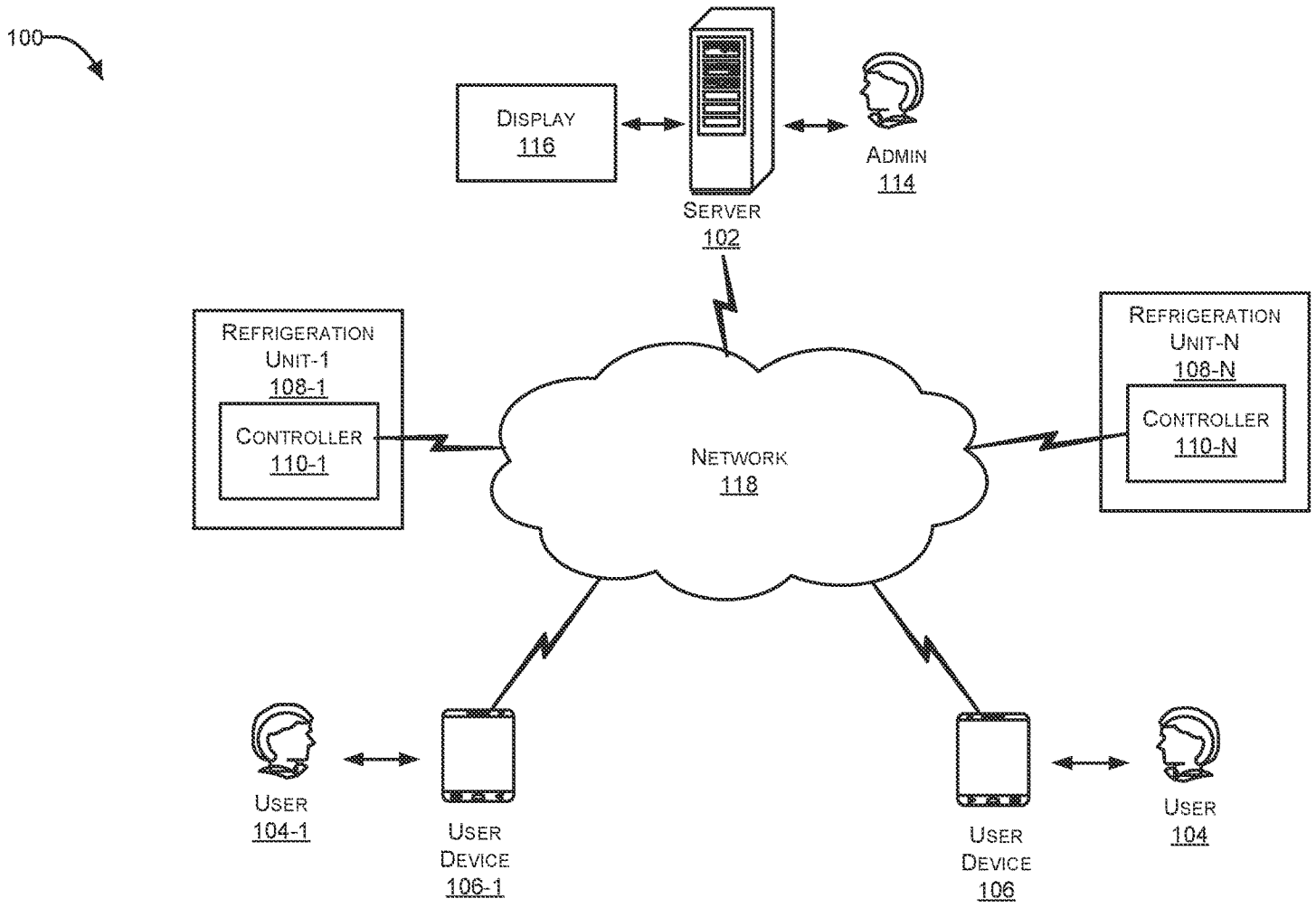
FIG. 1 is a schematic diagram illustrating an exemplary network architecture of the system for predicting ice gradient in refrigeration units in accordance with one or more embodiments of the invention.

Referring to FIG. 1, one or more embodiments of the network architecture of the system 100 is illustrated. According to network implementation, the system 100 enables the prediction of ice gradient and the impact of the ice gradient in one or more refrigeration units 108-1 to 108-2 (collectively referred to as refrigeration units 108, herein). While the system 100 has been explained considering that the system 100 is implemented as a web-application on a server 102, it may be understood that system 100 may also be implemented in a variety of computing systems, such as a laptop computer, a desktop computer, a notebook, a workstation, a server, a network server, a cloud-based environment, and the like. It would be appreciated that the system 100 is accessed by multiple users 104-1, 104-N (collectively referred to as users 104, hereinafter), through one or more user mobile devices 106-1, 106-N (collectively referred to as user devices 106, hereinafter), or applications residing on the user devices 106. The mobile devices 106 may be smartphones, laptop, computer, tablets, and portable handheld computing devices associated with the users 104. Users 104 may be an individual registered person, a group of registered persons, an organization, and the like, which are associated with the operation, service, and/or maintenance of the refrigeration units. The user 104 may also be the owner of the refrigeration units 108. Further, the system 100 is accessed by an administrator 114 (admin) at the server end 102. At the server end, the system may include a display 116 that enables the admin 114 to monitor the operation of the system 100 and the refrigeration units 108.

In one or more embodiments, the system 100 registers the users as registered users 104, upon positive verification of their registered mobile devices 106 by the admin 116 at the server end. The system 100 requests and receives, upon a first communicative coupling (or first-time registration) of the user's mobile devices 106 with the server 102, the details of the corresponding user from the mobile devices 106 of the users 104, and correspondingly registers the users as the registered user 104 upon positive verification of the corresponding user details by the admin 114. In one or more embodiments, the details of users 104 may include name, photo, age, gender, mobile number, location, biometrics details, expertise, experience, and training certificates of the registered users, but not limited to the like. Users 104 and entities 108 may access the system 100 through a mobile or web application residing on their mobile device 106, 110 or through a website.

The system 100 further involves a controller 110-1, 110-N (collectively referred to as controller 110, herein) associated with each of the refrigeration units 108. These controllers 110 are configured to monitor the real-time parameters of the refrigeration units 108 and also control the operation of the refrigeration units 108. In instances, when there is a communication failure between the controller 110 and the server 102 due to being out of network coverage, the controller 110 stores the parameters data of the refrigeration units 108 and reports it to the server 102 when communication between them is re-established. The detailed operation and functional modules of the controller 110 have been described later in conjunction with FIG. 5.

The system 100 registers the refrigeration unit 108 and the corresponding controller 110 with the server 102 at the time of installation, upon communicative coupling of the refrigeration unit 108 or controller 110 with the server 102. In some embodiments, the refrigeration units 108 may be associated with the same service provider. In another embodiment, a set of refrigeration units 108 may be associated with one service provider, and another set of refrigeration units 108 may be associated with a different service provider, however, the server allows all the refrigeration units (from different service providers) to be registered with and controlled by the server 102 upon authorization by the user/owner 104 of the refrigeration unit 108 and validation and authorization by the admin 114 at the server end 102. The refrigeration units 108 of different service providers may be configured to be operatively connected to the server 102 by reconfiguring or programming the corresponding controller 110 by an expert or technician, thereby enabling the refrigeration units 108 of different service providers to communicate with the server 102.

The controller 110 is configured to monitor/capture parametric data related to the performance of the refrigeration units. The collected data are stored and transferred to the server 102 through the network at predefined intervals or in real-time. The collected parametric data may include evaporator surface temperature, evaporator input temperature, evaporator output temperature (refrigerant flow side), supply air temperature, return air temperature, rack evaporator temperature, rack condensing temperature, defrost status, cooling status, expansion valve opening degree, and other configuration details. Along with dynamic parameters, static parametric data related to refrigeration's attributes such as size, type, design, and cooling type along with operational policies are also collected by the server 102. Further, the collected data is correlated by the server 102 to create features that provides the characteristics of the refrigeration units' performance. These characteristics features explain the performance of each component in the refrigeration units, which may include but is not limited to defrost characteristics, heat exchange characteristics, return air temperature characteristics, and expansion valve characteristics. Further, the server 102 generates one or more events based on the generated characteristic features.

Figure 6A:
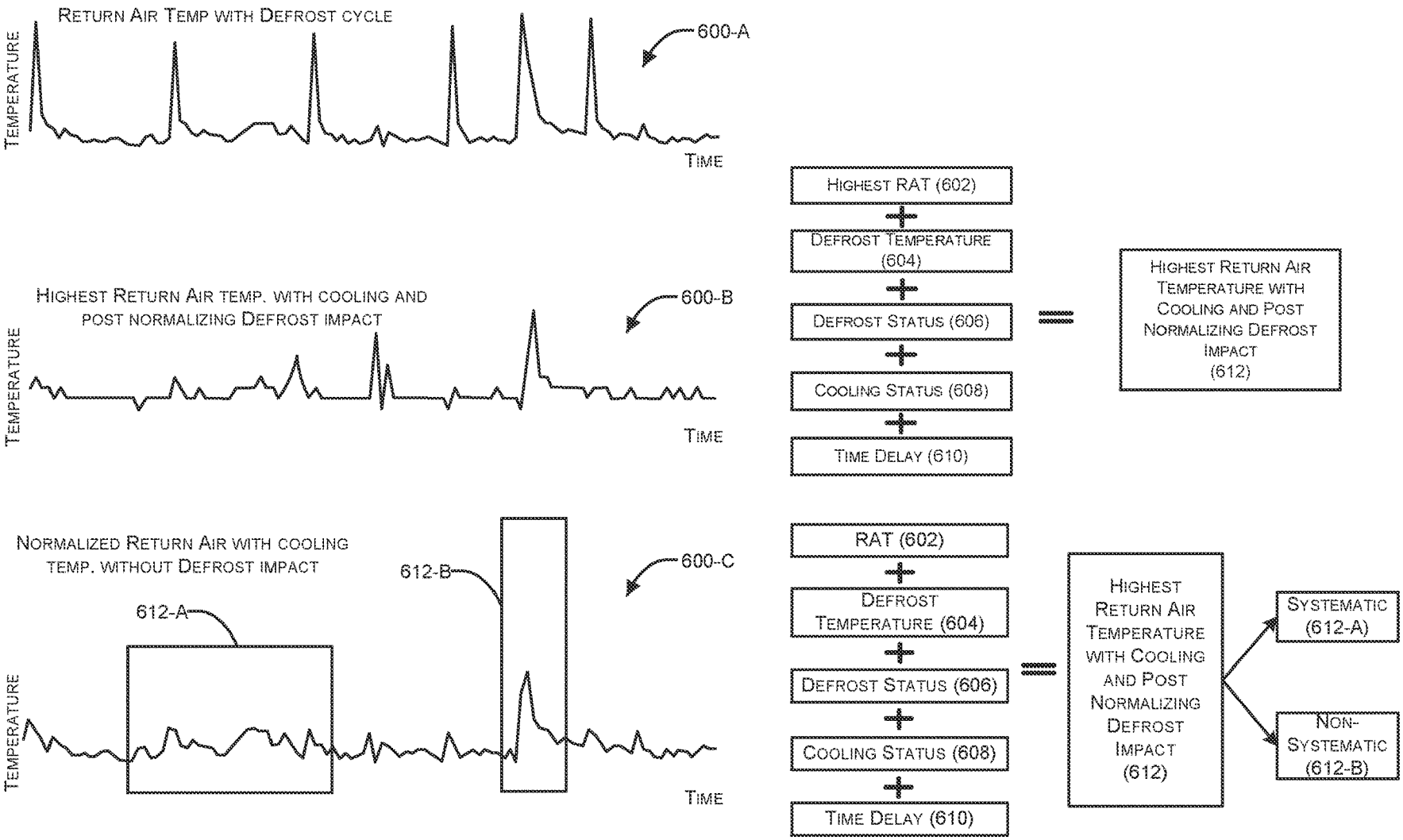
FIGS. 6A and 6B illustrate exemplary graphs depicting the process of systematic and non-systematic events identification, normalization, and differentiation in accordance with one or more embodiments of the invention.
Figure 6B:
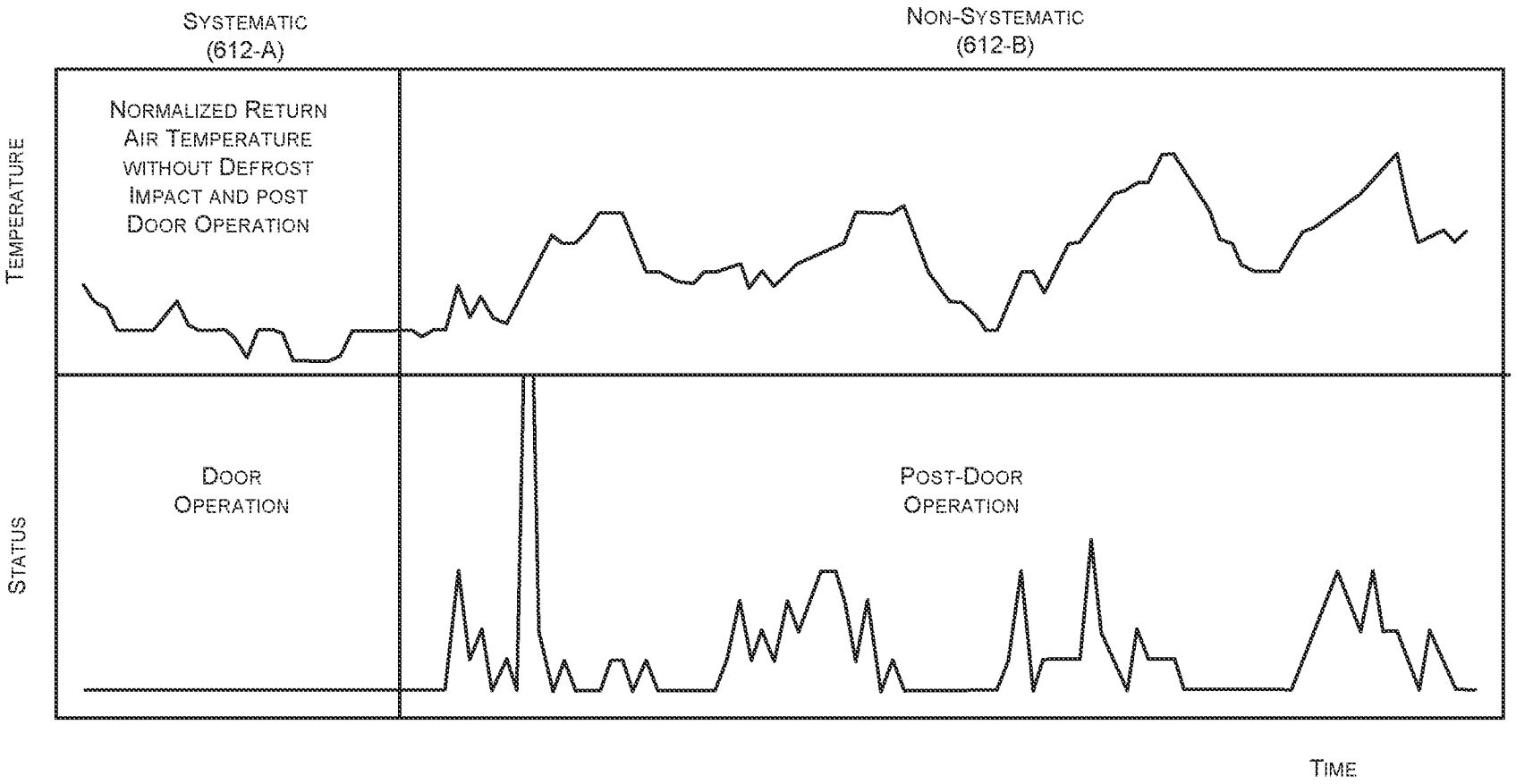

In some instances, there may be events that may be repeated for the refrigeration units (refrigeration cabinets/rooms) to maintain its expected performance level. These events are systematic events that may be scheduled operations of the cabinet/room, stocking of cabinet/room, temperature of the food stored within the cabinet/room, and configuration led operations of the cabinets/rooms). Accordingly, the one or more generated events are differentiated by the server 102 into systematic events and non-systemic events. In this process, various patterns are generated which are analyzed to distinguish the frosting pattern. The frosting pattern (behaviour) is separated from the other component patterns by normalizing out the other patterns as illustrated in FIGS. 6A and 6B. Referring to FIGS. 6A and 6B, the process of analyzing various frosting patterns to distinguish the events into systematic and non-systematic events includes steps of identifying various frosting patterns by correlating the data (parameters) captured from the refrigeration unit to generate one or more events, normalizing generated events that are not associated with frosting issue to provide normalized frosting patterns, and differentiating the events into systematic events and non-systemic events post normalization. Graph 600A illustrates an exemplary frosting pattern generated by the server upon correlating the RAT with defrost cycle data. As the defrost cycle may not lead to frosting issues in the refrigeration unit, the parameters (defrost temperature 604 and defrost status 606) associated with the defrost cycle may be normalized from the pattern 600A to provide a normalized frosting pattern 600B/

600C. Frosting pattern 600C (enlarged view of pattern 600B) may be generated and analyzed by the server upon correlating the highest RAT 602 with cooling status 608 post normalizing the defrost temperature 604 and defrost status 606 to generate one or more events 612. Furthermore, the frosting pattern 600C may be analyzed by the server to differentiate the corresponding events 612 into systematic events 612-A and non-systematic events 612-B. For example, as can be inferred from FIG. 6B, the door operation event 612-A in the refrigeration unit may not lead to frosting issues in the refrigeration unit as the temperature in the refrigeration unit remains controlled during the door operation event 612-A. Thus, the event 612-A may be identified as a systematic event. Further, the post door operation event 612-B may lead to frosting issues as there is variation in temperature in the refrigeration unit. Thus, the event 612-B may be selected by the server as a non-systematic event.

Further, the combination of the selected frosting patterns (behaviour) are correlated with a trend of increase, quantum of variation, and recency of the pattern. These patterns (behaviour) provide indicators on the icing quantum, the rate of accumulation through which ice gradients with time to breach (based on time/event or both) have arrived. Accordingly, the ice gradient may be taken as input to act upon and overcome the frosting. The detailed operation of the system 100 and server 104 has been described later in conjunction with FIGS. 2A and 2B.

The mobile devices 106 of the users 104 and the display 116 of the server 102 allow them to monitor the parameters data (dynamic as well as static) being notified by the controllers 110 or technicians 104. The server 102 notifies and/or sends alert signals to the mobile devices 106 in form of text messages, emails, and the likes.

The system 100 may be operatively coupled to a website and so be operable from any Internet-enabled user device 106. Examples of user devices 106 may include but are not limited to, a portable computer, a personal digital assistant, a handheld device, and a workstation. The user devices 106 and controllers 110 are communicatively coupled or in communication with server 102 through a network 118.

In one implementation, the network 118 may be a wireless network, a wired network, or a combination thereof. Network 118 may be implemented as one of the different types of networks, such as intranet, local area network (LAN), wide area network (WAN), the internet, and the like. Further, the network 118 may either be a dedicated network or a shared network. The shared network represents an association of the different types of networks that use a variety of protocols, for example, Hypertext Transfer Protocol (HTTP), Transmission Control Protocol/Internet Protocol (TCP/IP), Wireless Application Protocol (WAP), and the like, to communicate with one another. Further, network 118 may include a variety of network devices, including transceivers, routers, bridges, servers, computing devices, storage devices, and the like. In another implementation the network 118 may be a cellular network or mobile communication network based on various technologies, including but not limited to, Global System for Mobile (GSM), General Packet Radio Service (GPRS), Code Division Multiple Access (CDMA), Long Term Evolution (LTE), WiMAX, 5G or 6G network protocols, and the like.

Figure 2A:
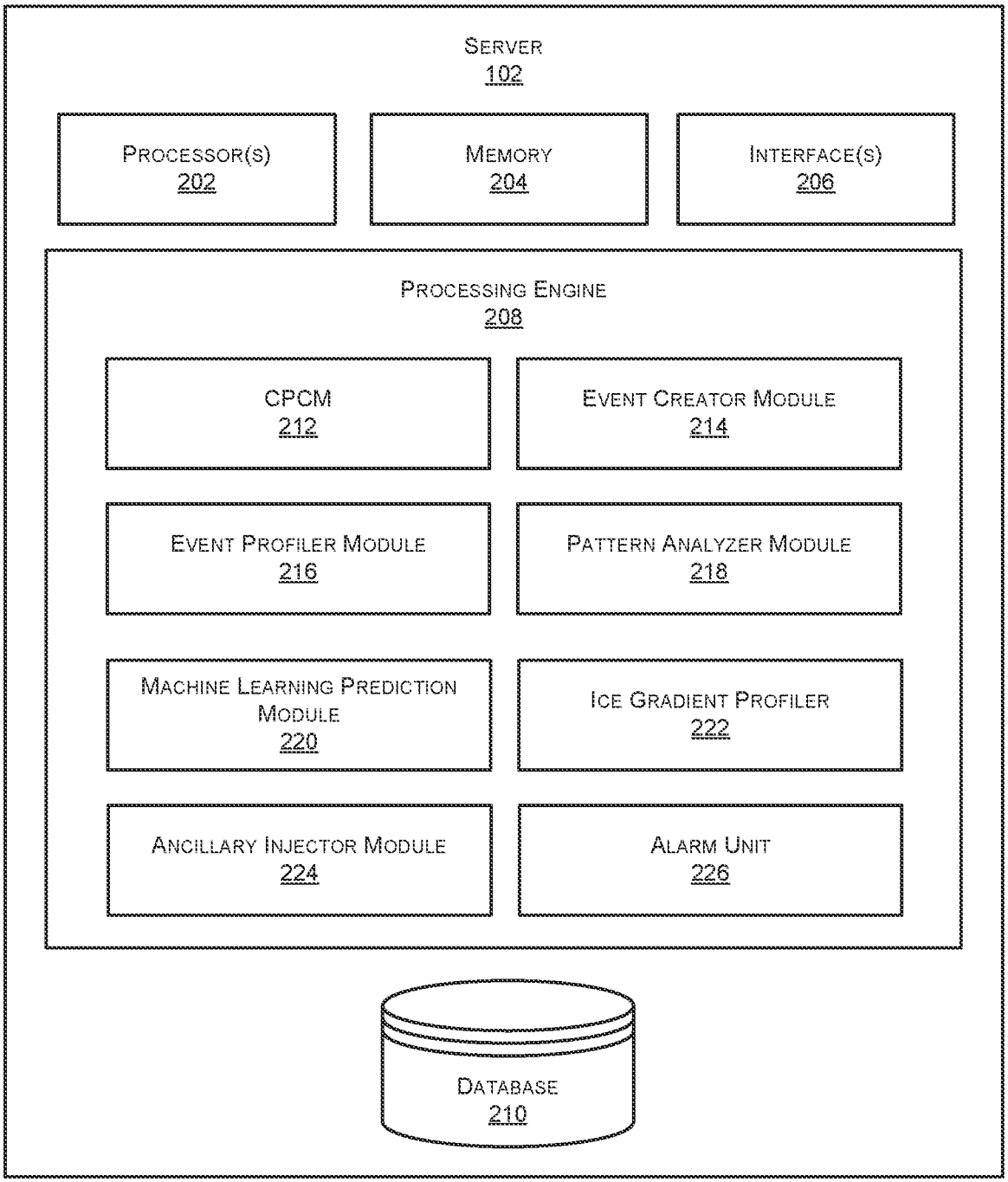
FIG. 2A is a schematic diagram illustrating exemplary functional modules of the server of the system in accordance with one or more embodiments of the invention.
Figure 2B:
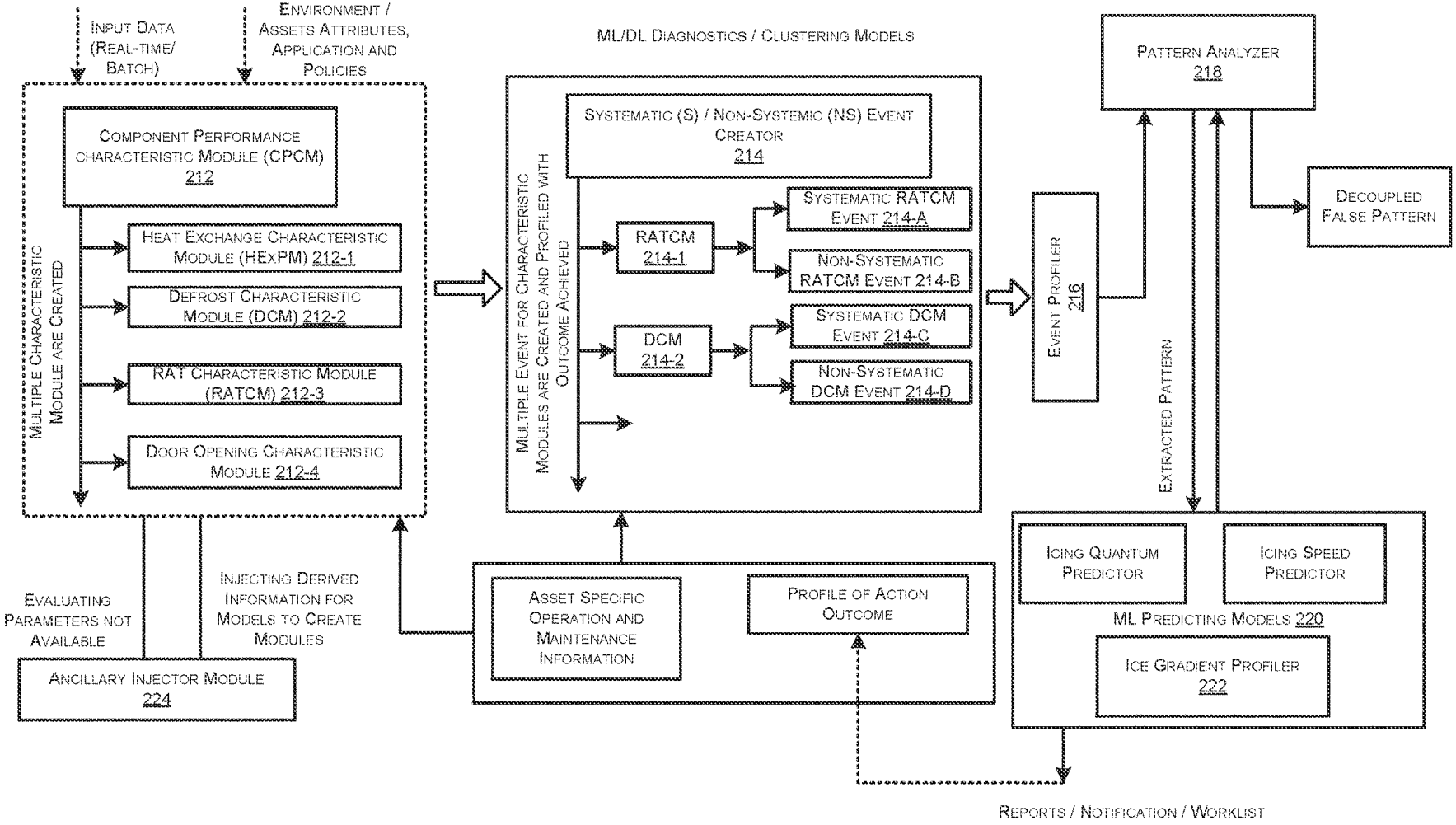
FIG. 2B is an exemplary flow diagram illustrating the working of the system in accordance with one or more embodiments of the invention.

Referring to FIGS. 2A and 2B, the functional modules of server 102 of the system 100 are illustrated. The server 102 comprises one or more processor(s) 202 operatively coupled to a memory 204. The one or more processor(s) 202 may be implemented as one or more microprocessors, microcomputers, microcontrollers, digital signal processors, central processing units, logic circuitries, and/or any devices that manipulate data based on operational instructions.

Server 102 also comprises an interface(s) 206 that may comprise a variety of interfaces, for example, interfaces for data input and output devices, referred to as I/O devices, storage devices, and the like. The interface(s) 206 may include a communication module to facilitate communication of server 102 with the controllers 110, the user devices 106, and the display 116 through the network 118. The interface(s) 206 may also provide a communication pathway for one or more internal components or modules of the server 102 and with a mobile device of the admin. Examples of such internal components include, but are not limited to, processing engine(s) 208 and data (database) 210.

The processing engine(s) 208 is implemented as a combination of hardware and programming (for example, programmable instructions) to implement one or more functionalities of the processing engine(s) 208. In other examples, the processing engine(s) 208 may be implemented by an electronic circuitry. The data 210 may comprise data that is either stored or generated as a result of functionalities implemented by any of the components of the processing engine(s) 208 or system 100.

In one or more embodiments, the processing engine(s) 208 may include a component performance characteristic module (CPCM) 212, an event creator module 214, an event profiler module 216, a pattern analyzer module 218, a machine learning-based prediction module (ML module) 220, an ice gradient profiler 222, an ancillary injector module 224, and alarm unit 226, and other modules (s). Other module(s) may supplement the functionalities of the processing engine 208 or the server 102.

In one or more embodiments, the CPCM 212 may be configured to enable the server to receive the time series parametric data from the refrigeration system 108 (or controller 110). The collected data may include one or more of evaporator surface temperature, evaporator input temperature, evaporator output temperature (refrigerant flow side), supply air temperature, return air temperature, rack evaporator temperature, rack condensing temperature, defrost status, cooling status, expansion valve opening degree (OD %), and other configuration details. Along with the dynamic parametric data, static parametric data is received by the CPCM, which may include one or more of the type of controller, type of asset, cooling type as attributes, and operational policies associated with the refrigeration unit.

The CPCM 212 enables the server 102 to correlate the received parameters (parametric data) to generate one or more characteristic features indicative of behaviour and performance of components of the refrigeration units 108. The generated characteristic features may include one or more of defrost characteristics, heat exchange characteristics, return air temperature characteristics, and expansion valve characteristics, but are not limited to the like. As shown in FIG. 2B, the CPCM 212 may include a heat exchange characteristics module 212-1, a defrost characteristics module 212-2, a return air temperature characteristics module 212-3, a door opening characteristic module 212-4, and an expansion valve characteristics module that generates the corresponding characteristic features based on the correlated parametric data.

Figure 4:
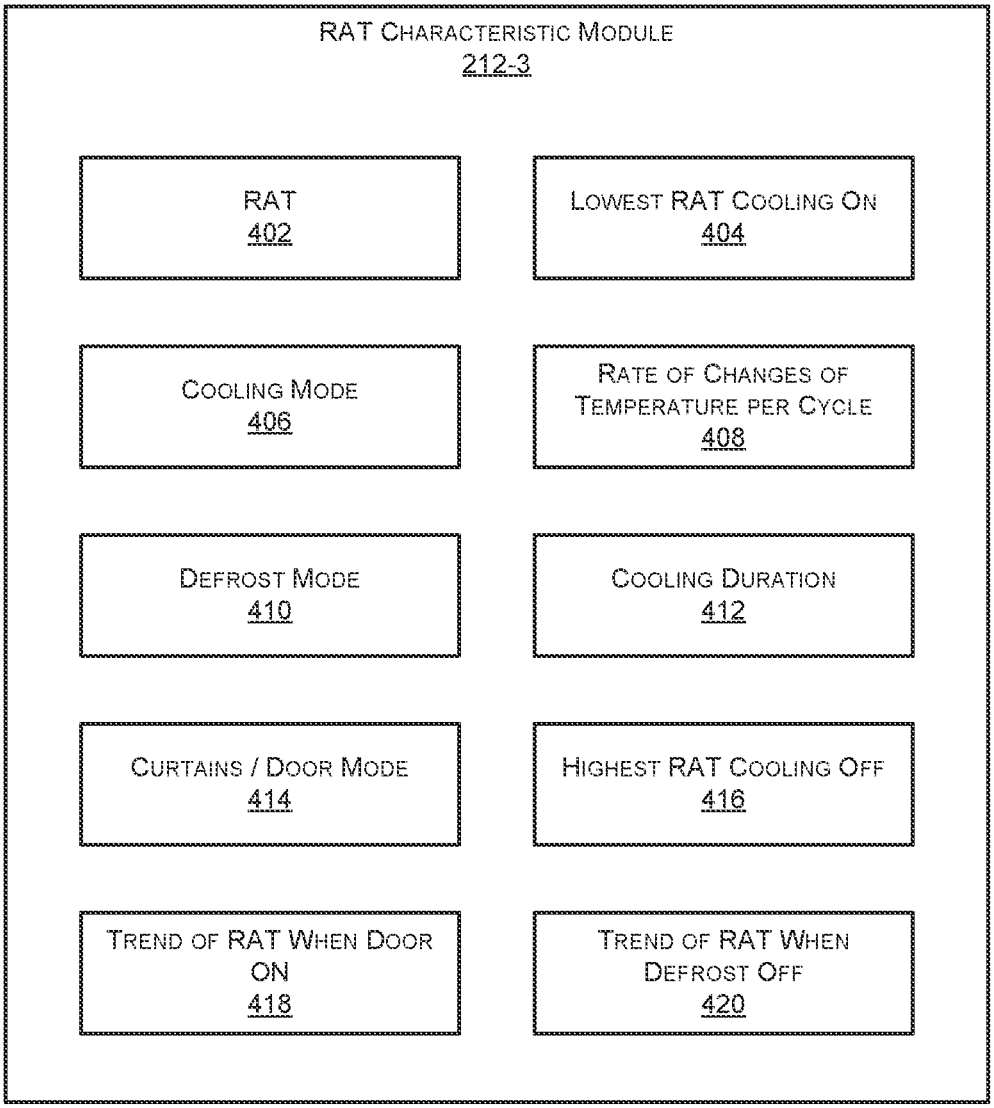
FIG. 4 is a schematic diagram illustrating an exemplary architecture of the return air temperature (RAT) characteristic module of the system in accordance with one or more embodiments of the invention

In an example, as shown in FIG. 4, in the return air temperature (RAT) characteristic module 212-3, the multiple characteristics are generated by correlating RAT 402 with cooling mode 406 to obtain information related to performance of the refrigeration unit. The information related to the performance may include one or more of the rate of temperature drop within a cooling cycle, the lowest temperature reached during each cycle, the time taken to reach the lowest temperature, and the increase of RAT when cooling is off. Similarly, in the RAT characteristic module 212-3, parameters such as the lowest RAT when cooling is ON 404, the cooling mode 406, rate of changes of temperature per cycle 408, defrost mode 410, cooling duration 412, curtain/door mode 414, highest RAT when cooling is OFF 416, trend of RAT when the door is closed 418, and/or trend of RAT when defrost is OFF 420, associated with the refrigeration unit may be correlated with each other at different levels to obtain performance of the refrigeration units. In another example (not shown), the defrost characteristic information generated by the defrost characteristic module 212-2 may include one or more of temperature reached during defrosting (e.g., highest temperature), time taken to reach highest temperature, time taken to cool after defrosting, temperature before defrosting, temperature after defrosting, and the likes. In yet another example, door opening characteristic information generated by the door opening characteristic module 212-4 may include one or more of return air temperature, and evaporator temperature. Similarly, the expansion valve characteristics, the heat exchange characteristics, and other characteristics are generated by the expansion valve characteristic module, the heat exchange characteristic module 212-1, and other modules respectively.

In one or more embodiments, these characteristic features may be generated based on three inputs including input from a domain expert on the importance of the component characteristics, labelled maintenance work order information, and machine learning/deep learning based component characteristic generation, based on data of the system across sites along with the static information. The machine learning module 220 of the server 102 identifies the importance of the component characteristic feature. Further, the ML module 220 determines the performance baseline with the same group of refrigeration units within a site (AOI) or enterprise.

In some embodiments, the characteristic features are generated by aggregating at different levels like cycles, hourly, days, weeks, and months for every refrigeration unit in the database 210 associated with the server 102, followed by correlating between the characteristic features at different levels. As refrigeration unit's behaviours may vary at multiple levels, for instance, RAT performance may vary when cooling is on and off, when the door is open and when the door is not open, when the cabinet is overstocked, when humidity is high, when expansion valve operation due to lack of refrigerant, and expansion valve operation when superheat is met, thus, capturing the features at multiple levels helps determine the frosting by normalizing other behaviours. Normalizing the behaviours like overstocking, air circulation, low refrigerant, sensor failures, and the like is employed in the system to determine the frosting pattern. This CPCM 212 also captures the error-prone data and excludes the characteristic features (like sensor constant values, sensor out-of-range values, and sensor drift values compared to other sensors.

In one or more embodiments, the ancillary injection module 224 enables the server 102 to derive data based on the information available from known refrigeration units. Data is derived from the parameters already available with the system 100. These derived parameters such as superheat may be derived from evaporator input and evaporator output temperature, cooling mode may be derived from expansion valve, defrost status may be derived from evaporator temperature, and the like. This ancillary injection module 224 is useful for legacy refrigeration units (legacy systems) that are not associated with the service provider or refrigeration units where the measured parameters are less or are from a different service provider (vendor). The ancillary injection module 224 enables the server 102 to determine unavailable parameters associated with a set of refrigeration units (e.g., legacy systems with limited data) among the refrigeration units based on the available (known) parameters associated with another set of refrigeration units (e.g., associated with the service provider) among the refrigeration units. In addition, the system 100 may be implemented at multiple sites or enterprises having different sets of refrigeration units (assets). The data/information collected from these enterprises may be used for benchmarking of different types of assets so that the collected data may be provided as feedback to the system 100 to continuously learn and improve. The benchmarking may be done based on feedback from domain expertise, from work orders, and/or feedback from customer after service.

In one or more embodiments, the event creator module 214 enables the server 102 to generate one or more events 214-1, 214-2 based on the characteristic features generated by the CPCM 212 and correspondingly classify the generated events 214-1, 214-2 into a systematic event 214-A, 214-C and a non-systematic event 214-B, 214-D. The identified events may either be systematic or non-systematic in nature. For instance, in one example, the RAT temperature to be maintained within a setpoint based on PID logic control is a systematic event. Examples of non-systemic events include events such as when the RAT is not maintained, as a result of which, the refrigeration unit operates accordingly to meet the requirement. Further, door opening more frequently than usual may trigger a non-systemic event as the refrigeration unit takes more time than usual to adjust. Furthermore, the "Highest RAT cooling on" increasing with a slope higher than usual between defrost cycles is also an example of a non-systemic event. Similarly, the "Superheat below the threshold" duration being higher than usual is also an example of a non-systemic event. The defrost temperature decreasing over multiple cycles with heater-based defrosting is also an example of a non-systemic event.

Non-systemic events may be classified broadly into customer operations, refrigeration unit's performance, and environmental reasons. The non-systemic events are classified by various machine learning algorithms. The ML module/server 102 classifies the identified events by learning from refrigeration unit performance, with the same group of the refrigeration unit, within a site or enterprise. Further, work order information may be provided as labeled information to be included as feedback to improve ML module's outcome.

In one example, after excluding the systematic events like defrost cycle, door operation across cycles and days, and the like, there may be an increase in RAT during working hours repeating every day. As a result, the refrigeration unit is marked with non-systemic event behaviour. Finally, the event profiler module 216 enables the server 102 to combine the multiple non-systematic events by excluding the systematic events.

In one or more embodiments, the pattern analyzer module 218 enables the server 102 to normalize the outcome (combined non-systematic events) of the event profiler 216 to identify the frosting pattern from the available non-systemic events. Non-systemic behaviours may be analyzed based on one or more of a trend, a recent performance, and a quantum of variations. The pattern analyzer module 218 enables the server 102 to determine each of the non-systemic behaviour patterns values of the trend, recent performance, and quantum of variation. A matrix associated with the analyzer may be dynamically configured in the database 210 of the server 102, based on feedback from domain expertise, work orders, and feedback from customers after service of the refrigeration units. In addition, the matrix may also be configured in the database 210 by the user 104 at any time. This matrix provides information to the analyzer to extract the patterns which are associated with frosting and normalize the patterns which are not associated with frosting by continuously learning, thereby identifying the frosting pattern. Further, the matrix may have threshold values to extract the required icing-related pattern. The non-systemic event profiles and the threshold values are updated frequently in the matrix (configured in the database 210) by ML module 220 of the server 102 to continuously learn from the associated actions and associated improvements for these actions. This continuous learning is achieved based on feedback from domain expertise, work orders, and feedback from customers after service.

Figure 7:
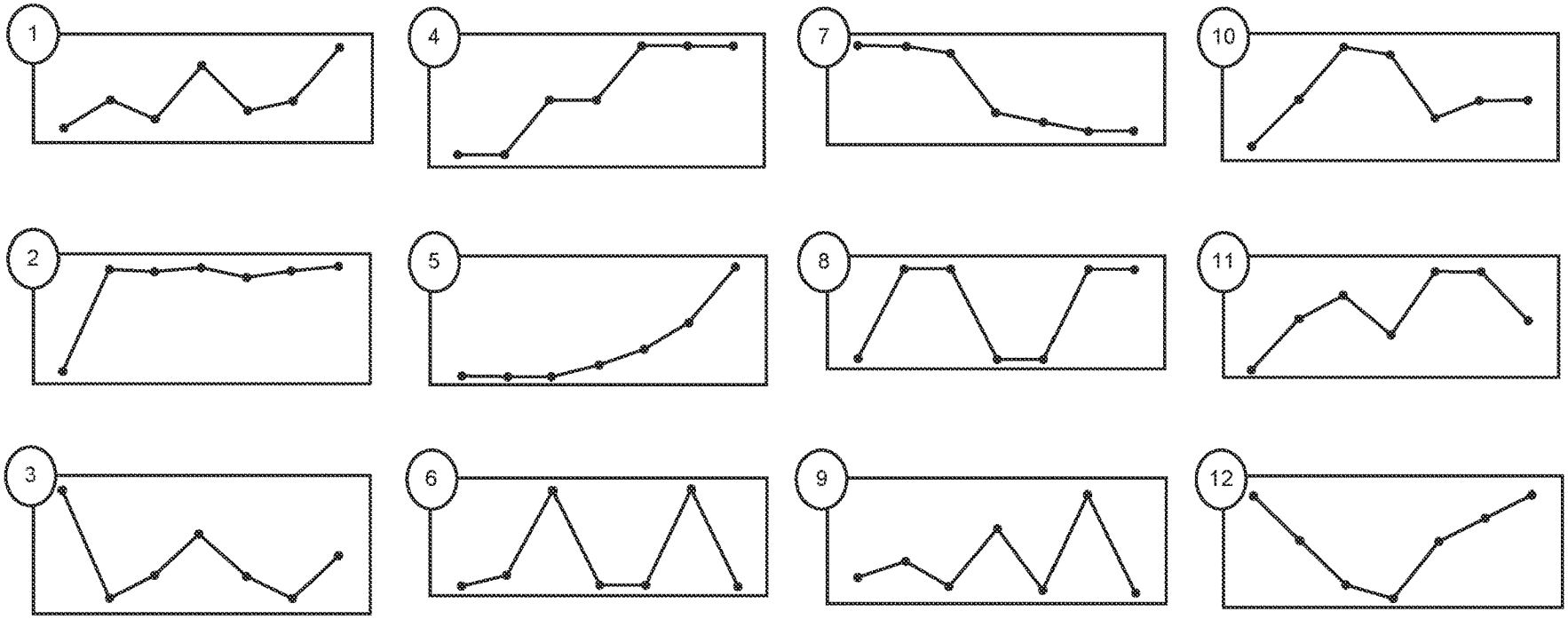
FIG. 7 illustrates an exemplary representation depicting various patterns extracted by the pattern analyzer in accordance with one or more embodiments of the invention.

Referring to FIG. 7, patterns of various non-systematic events of return air temperature (RAT) associated with different refrigeration units during 24 hours of a day are illustrated. The pattern analyzer enables the server to extract pattern number 1, 4, 5, 11, and 12 as icing issues or related to frosting and normalizes out the remaining patterns 2, 3, 6, 7, 8, 9, and 10. The extraction is done based on the threshold provided in the matrix. Patterns 1, 4, 5, 11, and 12 show an increasing and/or uncontrolled trend of variation in RAT in the refrigeration units, which may generally lead to icing or frosting issues in the refrigeration unit. Further, as the other patterns 2, 3, 6, 7, 8, 9, and 10 either shows a decrease in RAT or a controlled variation in RAT during 24 hours of the day, these patterns 2, 3, 6, 7, 8, 9, and 10 may not lead to icing or frosting issues in the refrigeration unit. Thus, the pattern analyzer only extracts pattern numbers 1, 4, 5, 11, and 12 as icing issues or related to frosting and normalizes out the remaining patterns 2, 3, 6, 7, 8, 9, and 10.

Figure 8A:
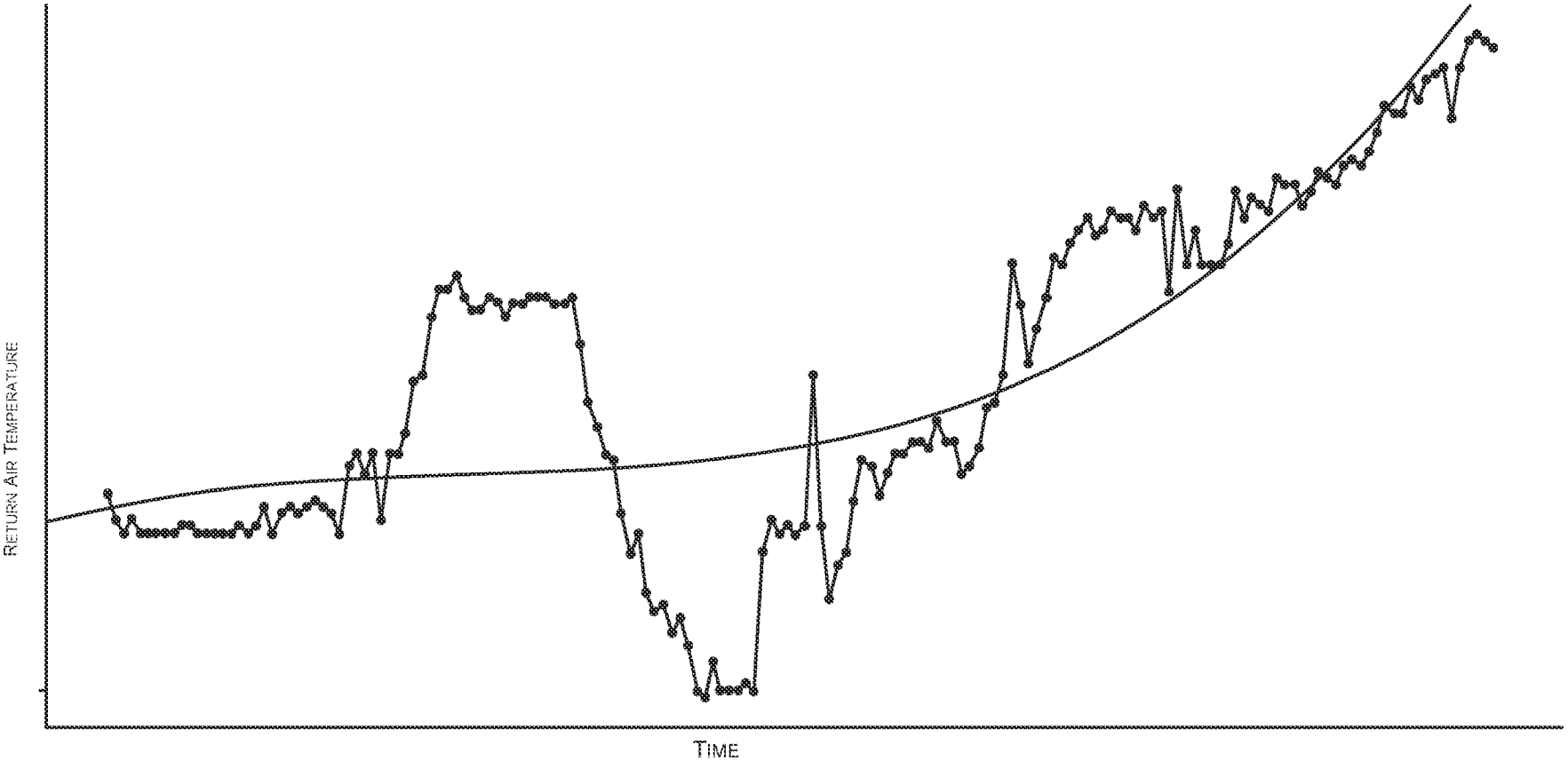
FIGS. 8A to 8C illustrate exemplary graphs representing RAT data analyzed by the ice gradient profiler to determine the priority of ice gradient for the refrigeration units in accordance with one or more embodiments of the invention.
Figure 8B:
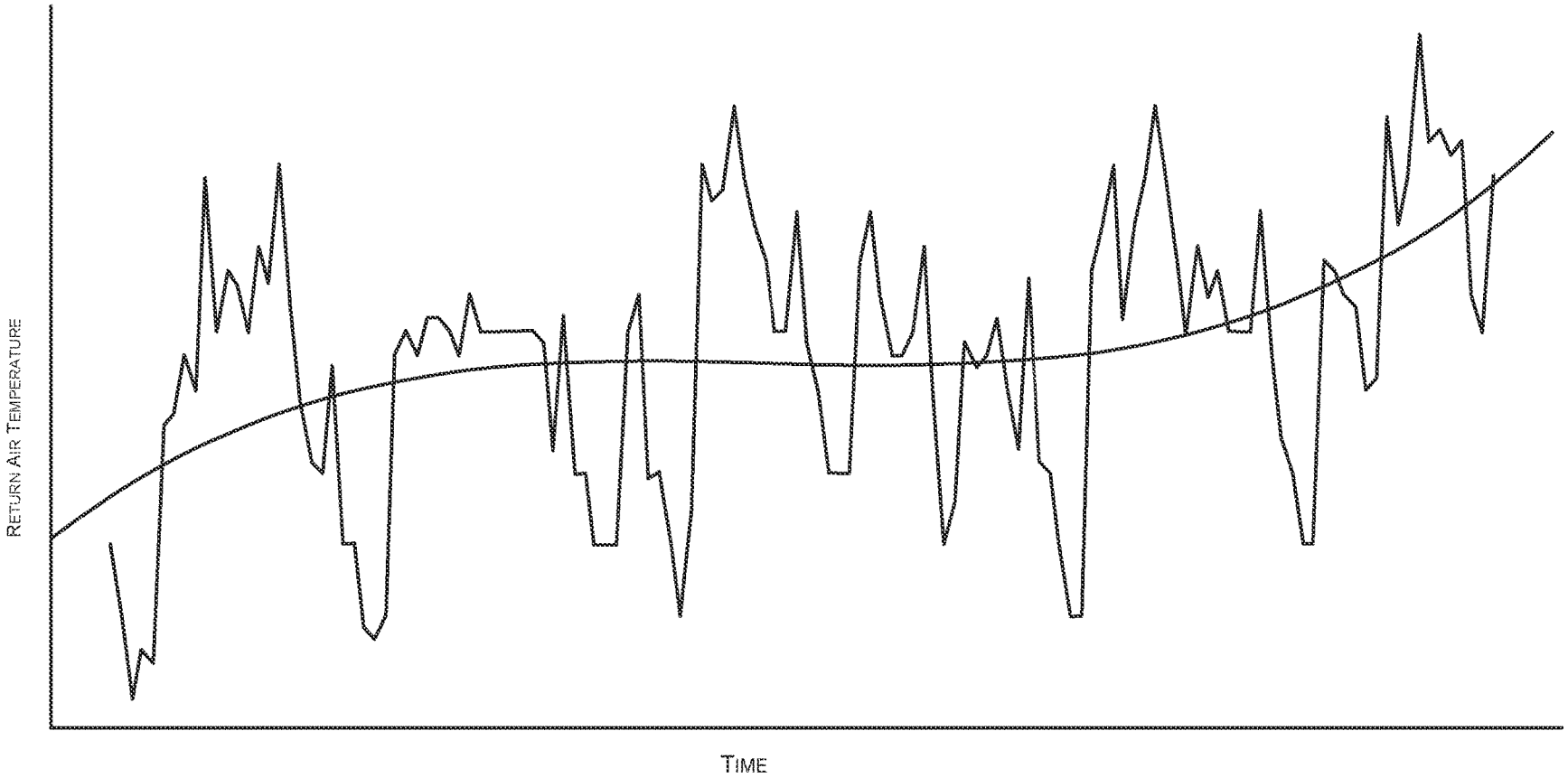
Figure 8C:
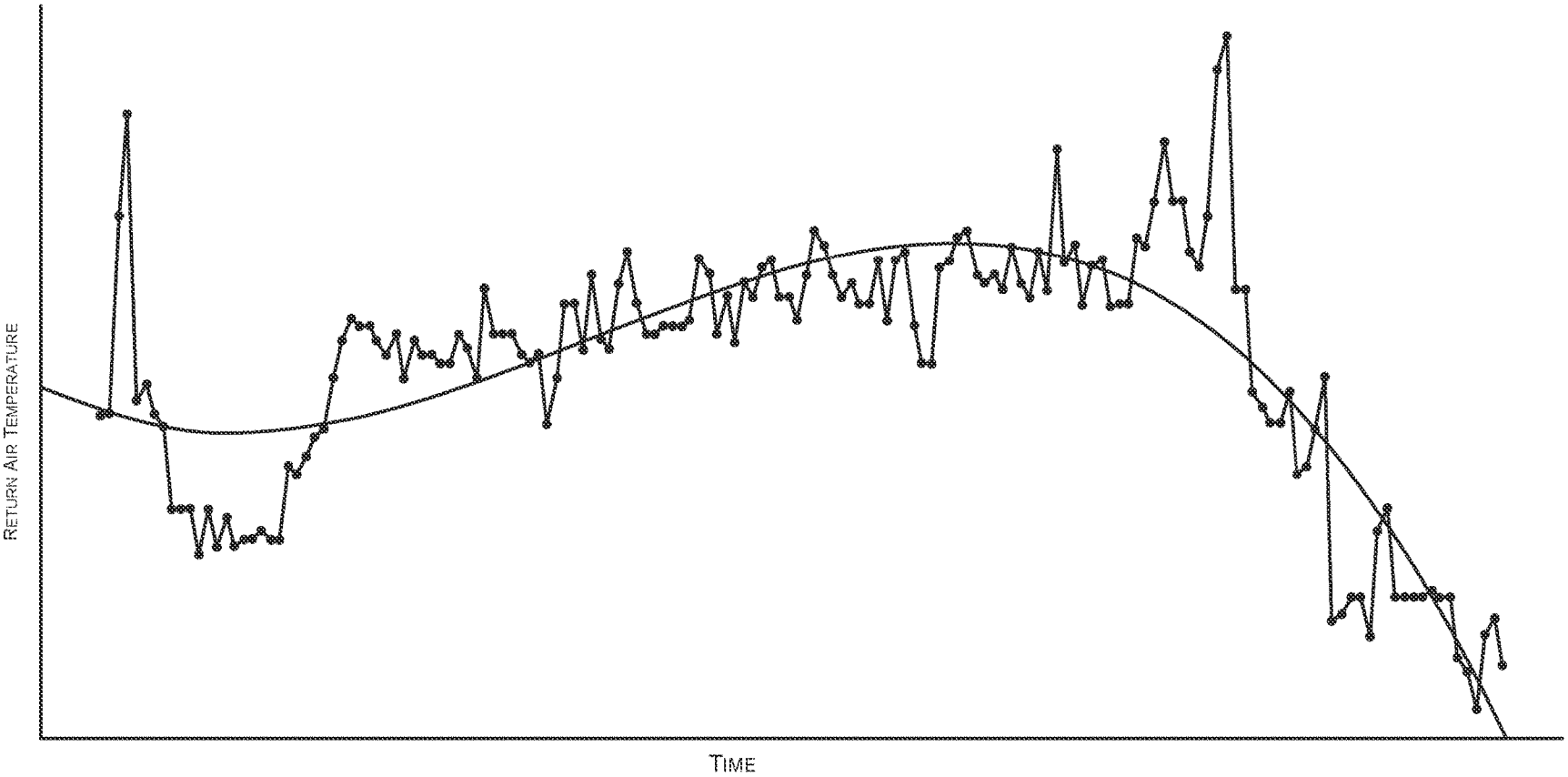

In one or more embodiments, the frosting patterns extracted from the pattern analyzer module are processed by the ice gradient profiler 222 to determine the quantum of icing and rate of ice formation. Referring to FIGS. 8A to 8C, exemplary graphs representing RAT data of different refrigeration units analyzed by the ice gradient profiler during a day to predict the ice gradient in the corresponding refrigeration units are illustrated. The icing formation may be gradual as inferred from FIG. 8B or rapid as inferred from FIG. 8A. For instance, rapid ice formation may occur between defrost cycles which requires immediate attention. Gradual ice formation may occur due to the slow degradation in the performance of the refrigeration unit. Gradual ice formation may also occur when the defrosting temperature does not reach the required temperature, when heat exchange is not performing well, or when superheat is decreasing.

An exemplary matrix for ice gradient prediction is shown in Table 1 below.

TABLE 1

| Icing speed predictor | Icing quantum predictor (hours) | Ice gradient profiler |
|---|---|---|
| 0.872 | 59.25 | Icing |
| 0.844 | 35.3 | Icing |
| 0.320 | 35.35 | Initial Icing |

TABLE 1-continued

| Icing speed predictor | Icing quantum predictor (hours) | Ice gradient profiler |
|---|---|---|
| −0.69 | 21.05 | No Issue |
| −0.2 | 45.02 | No Issue |

The quantum of icing (frosting) can be determined by the ice gradient profiler 222 using multiple methods such as but not limited to cumulative hours of deterioration, increase in the rate of change of temperature, and decrease in defrosting temperature. Further, the ice gradient profiler 222 may enable the server 102 to determine the slope of the increasing or decreasing trend of icing based on the non-systemic event profile as shown in FIGS. 8A to 8C. Accordingly, based on the values/slope of ice formation, priority may be determined and the server 102 may accordingly notify the required team to address the icing problem.

In one or more embodiments, the alarm unit 226 enables server 102 to generate and transmit a set of alert signals to the mobile devices 106 of the users 104 based on the priority of the predicted ice gradient. Further, when the threshold value of the predicted ice gradient exceeds a derived unsafe value, the server 102 may directly transmit a set of alert signals to the defrosting unit of the corresponding refrigeration unit 108 via the controller 110 to enable defrosting of the corresponding refrigeration unit 108. The unsafe value is a dynamic value that is derived and updated in the matrix or database 210 by continuous learning.

In one or more embodiments, the ML module 220 enables the server 102 to update the database 210 with a set of data packets comprising one or more of the captured parameters, the generated characteristic features, the identified non-systematic events and corresponding threshold values, the identified frosting pattern, the determined quantum of icing and rate of ice formation, and the predicted ice gradient. Further, the ML module 220 trains the server 102 using the updated database 210 to generate the characteristic features, identify the non-systematic events, identify the frosting pattern, determine the quantum of icing and rate of ice formation, and predict the ice gradient of the one or more refrigeration units in real-time at various processing stages of the server, thereby making the server 102 accurate and reliable in predicting the ice gradient.

Figure 3:
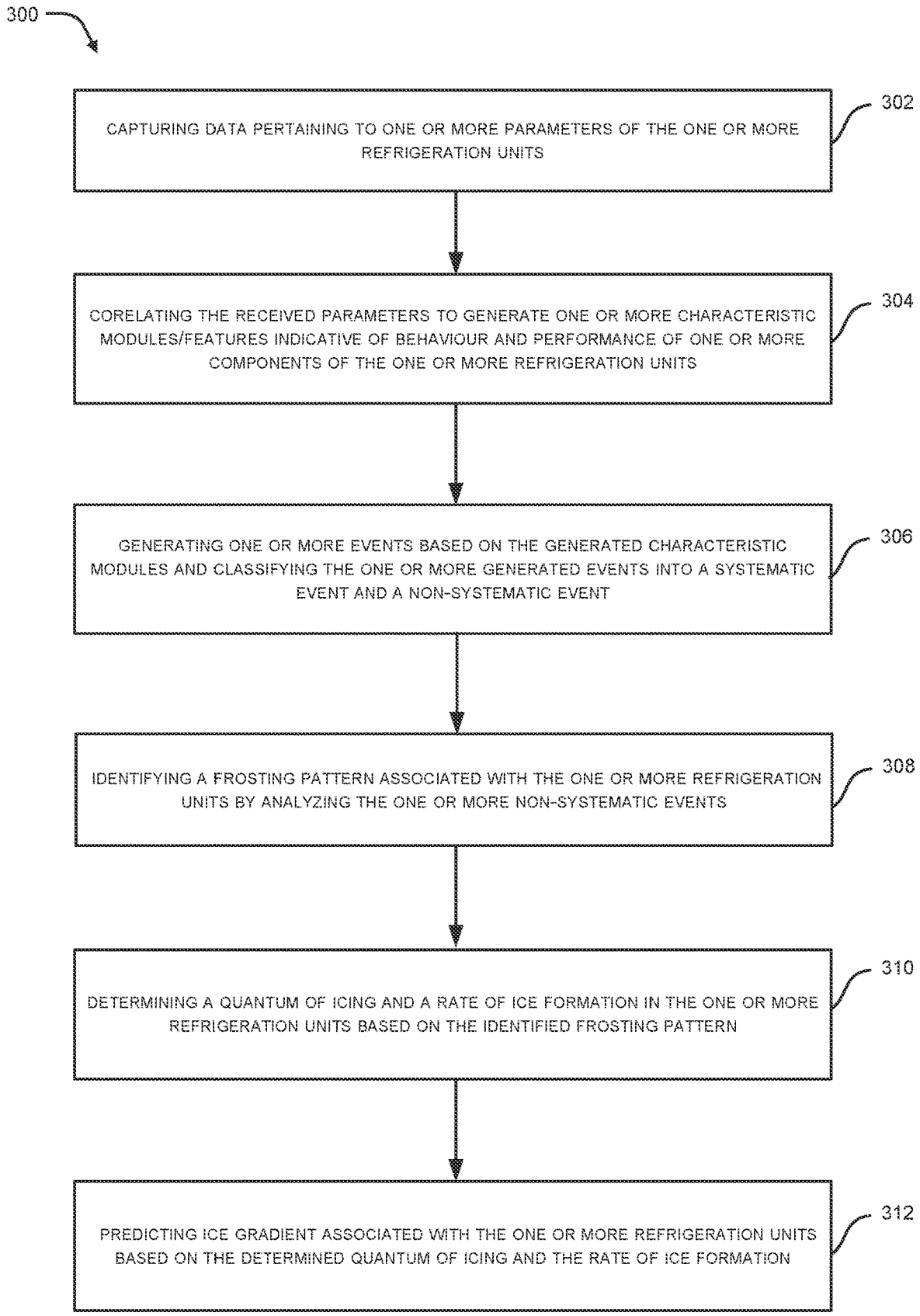
FIG. 3 is a flow diagram illustrating an exemplary embodiment of a method for predicting ice gradient in refrigeration units in accordance with one or more embodiments of the invention.

Referring to FIG. 3, exemplary steps involved in a method for predicting ice gradient in refrigeration units are illustrated. Method 300 includes step 302 of capturing data pertaining to one or more parameters of the refrigeration units. The parameters are captured by sensors associated with the controller of the refrigeration units. Method 300 further includes step 304 of correlating the received parameters to generate one or more characteristic features indicative of the behaviour and performance of components of the refrigeration units. The characteristic features include defrost characteristics, heat exchange characteristics, return air temperature characteristics, and expansion valve characteristics Further, method 300 includes step 306 of generating one or more events based on the generated characteristic features, and classifying the generated events into a systematic event and a non-systematic event. Method 300 further includes step 308 of identifying a frosting pattern associated with the refrigeration units by analyzing the identified non-systematic events. The frosting pattern from the non-systematic events is identified by normalizing the identified non-systematic events that are not associated with frosting. The non-systematic events are analyzed based on a trend, a recent performance, and a quantum of variation of the corresponding non-systematic events. This systematic isolation learning is continuously improved based on continuous learning by the server to provide proper non-systematic events. Furthermore, method 300 includes step 310 determining a quantum of icing and a rate of ice formation in the refrigeration units based on the identified frosting pattern, followed by step 312 of predicting ice gradient associated with the refrigeration units based on the determined quantum of icing and the rate of ice formation.

Further, method 300 includes the step of transmitting a set of control signals to a defrosting unit of the refrigeration units to control defrosting of the corresponding refrigeration unit based on the predicted ice gradient. In one or more embodiments when the predicted ice gradient exceeds a threshold value, method 300 includes the step of transmitting a set of alert signals to the defrosting unit of the refrigeration units to enable defrosting of the corresponding refrigeration unit. The threshold value of the ice gradient is a dynamic value that is determined and updated by continuously learning that is achieved based on feedback from domain expertise, work orders, and feedback from customers after service.

Furthermore, method 300 includes the step of determining unavailable parameters associated with a set of refrigeration units among the one or more refrigeration units based on the available parameters captured from another set of refrigeration units among the one or more refrigeration units.

Figure 5:
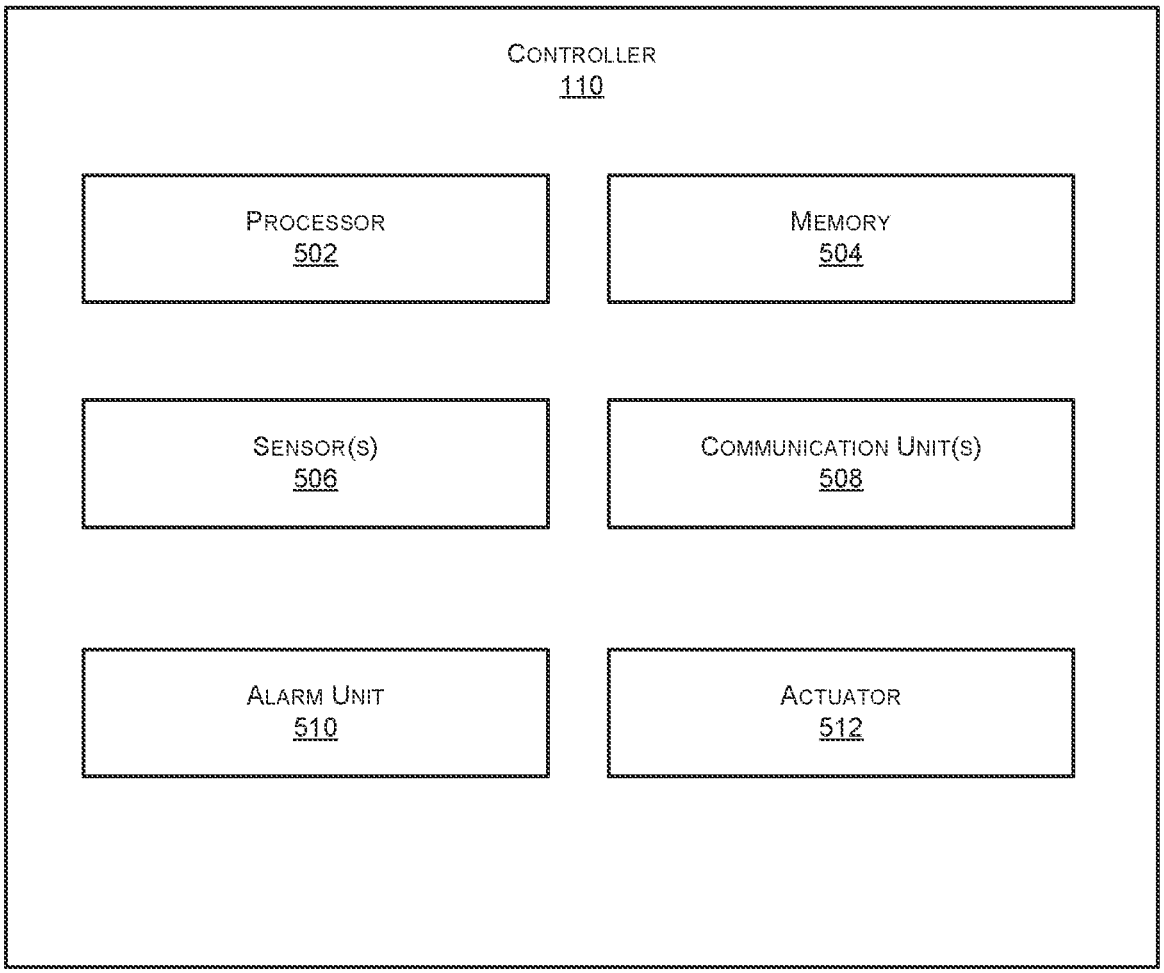
FIG. 5 is a schematic diagram illustrating the block diagram of the controller associated with the refrigeration units in accordance with one or more embodiments of the invention.

Referring to FIG. 5, an exemplary block diagram of the controller 110 installed in refrigeration units 108 of the system 100 is illustrated. The controller 110 includes a processor 502, a memory 504, a set of sensors 506, a communication unit 508 (such as a transceiver), an alarm unit 510, and an actuator 512 being configured within a single housing that may be installed in the refrigeration units 108 or disposed of within the refrigeration units 108. The processor 502 is coupled to the memory 504, the sensors 506, the transceiver 508, the alarm unit 510, and the actuator 512. The processor 502 includes suitable logic, circuitry, and/or interfaces that are operable to execute one or more instructions stored in the memory 504 to perform a predetermined operation. The memory 504 may be operable to store the one or more instructions. The processor 502 may be implemented using the processor 502 known in the art. Some of the commonly known memory 504 implementations include, but are not limited to, a random access memory (RAM), a read only memory (ROM), a hard disk drive (HDD), and a secure digital (SD) card. Further, memory 504 includes the one or more instructions that are executable by the processor 502 to perform specific operations. It is apparent to a person having ordinary skills in the art that the one or more instructions stored in the memory 504 enables the hardware of the mobile device to perform the predetermined operation.

The sensors 506 are configured to monitor the dynamic parameters of the refrigeration units 108. These dynamic parameters may include evaporator surface temperature, evaporator input temperature, evaporator output temperature, supply air temperature, return air temperature, rack evaporator temperature, rack condensing temperature, defrost status, cooling status, and expansion valve opening degree. Further, the parameters may also include static parameters such as the type of controller used in the corresponding refrigeration unit, attributes comprising type, size, design, and cooling type of the one or more refrigeration units, and operational policies associated with the one or more refrigeration unit, which may be manually collected. The sensors 508 may include temperature sensors, light sensors, humidity sensors, gas sensors, pressure sensors, and flow meters, but are not limited to the like. The captured parametric data of the refrigeration units 108 are then transmitted to the server 102 via transceiver 508 for further processing as already explained in detail in FIGS. 2A and 2B.

In some embodiments, the sensors 506 may be distributed at different positions within the zones of refrigeration units 108, and these distributed sensors 508 may be operatively connected to the processor 502 of the controller 110 via wired media or wireless media. In other embodiments, all the sensors 508 of the controller 110 may be positioned over a single frame that may be installed at different zones of the refrigeration units 108.

The communication unit 508 (transceiver 508) transmits and receives messages and data to/from the server 102 and the devices 106. Examples of the transceiver 508 may include but are not limited to, an antenna, an Ethernet port, an USB port, or any other port that may be configured to receive and transmit location and parameters data. The controller 110 further includes a power source such as a battery that is within the housing of the controller 110 to supply electrical power to the components of the controller 110. Besides, the controller 110 may also be electrically connected to a battery or power source of the refrigeration unit 108.

In one example, a GPS may be provided in the controller 110 to capture the location (coordinates) of the refrigeration unit 108, and the GPS data may be directly transmitted to server 102 via the transceiver 510, which may allow the user 104 to identify and reach at the installation site of the refrigeration unit 108 when required. In another example, the location of refrigeration unit 108 may be captured based on the interaction of a WIFI module of the controller 110 with nearby available WIFI access points. Once the controller 110 is in a range of any nearby available WIFI access points, the controller 110 determines its location to be the same as the location of the nearby available WIFI access points. In yet another example, the location of refrigeration unit 108 may be captured based on the interaction of the transceiver 510 of the controller 110 with a nearby cellular tower. Once the controller 110 is in the range of nearby cellular towers, controller 110 determines its location based on corresponding cellular tower triangulation.

In one or more embodiments, the alarm unit 510 enables server 102 to generate and transmit a set of alert signals to the mobile devices 106 of the users 104 based on the priority of the predicted ice gradient. Further, when the threshold value of the predicted ice gradient exceeds a derived unsafe value, the server may directly transmit a set of alert signals to the defrosting unit of the corresponding refrigeration unit via the controller 110 to enable defrosting of the corresponding refrigeration unit 108. The controller 110 may be an edge device that is configurable with the refrigeration units. The unsafe value of the ice gradient is dynamically derived and updated by continuously learning during the ice gradient prediction processes. The continuous learning and determination of the unsafe value is achieved based on feedback from domain expertise, work orders, and feedback from customers after service. In one or more embodiments, the controller 110 may also include actuators 512 that are configured to activate the defrosting system of the refrigeration unit 108 based on the priority of ice gradient mitigation.

Thus, the invention predicts ice gradient (or trend frost formation) in refrigeration units, thereby providing early warning and adequate time for action to mitigate the effect of frost formation.

According to another exemplary embodiment, a device (not shown) is disclosed, which is adapted to be connected or configured with one or multiple refrigeration units being installed locally at an area of interest (AOI) and is capable of predicting ice gradient in the refrigeration units. The device may replace the server 102 and perform all the combined functionalities of the server 102 as well as the controller 110 in the AOI. The device may be installed at the AOI near the refrigeration units 108 such that the corresponding refrigeration units 108 remain in a network coverage area around the device. In some embodiments, the device remains in communication with the controller 110 of all or any number of the refrigeration units 108 installed at the AOI, locally. In another embodiment, the device may include the controller 110 or associated components disposed of within a housing of the device, which allows the device to be operatively connected to the refrigeration unit and operate as the controller 110 for all the refrigeration units 108. Additionally, the device acts as the server 102 confined to the AOI and is configured to predict the ice gradient of the refrigeration units as already explained in detail in FIGS. 1 to 5. The refrigeration units of different service providers or the same service provider at the AOI may be configured to be operatively connected to the device by configuring or programming the corresponding controllers by an expert or technician.

The device may include a set of sensors (506 of FIG. 5) to capture and monitor the parameters of the refrigeration units. Further, the device includes a communication module (508 of FIG. 5) that communicatively couples the device to the refrigeration units 108 at the AOI. Furthermore, the device is configured to transmit a set of control signals to a defrosting unit of the refrigeration units 108 to control defrosting of the corresponding refrigeration unit based on the predicted ice gradient and its priority.

While the invention has been described with reference to exemplary embodiments, it will be understood by those skilled in the art that various changes may be made, and equivalents may be substituted for elements thereof without departing from the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A system to predict ice gradient in one or more refrigeration units, the system comprising:

a server in communication with the one or more refrigeration units, the server comprising a processor coupled to a memory storing instructions executable by the processor and a machine learning module configured to:

receive data pertaining to one or more parameters of the one or more refrigeration units;

correlate the received parameters to generate one or more characteristic features indicative of behaviour and performance of one or more components of the one or more refrigeration units;

generate one or more events based on the generated characteristic features;

identify a frosting pattern associated with the one or more refrigeration units by analyzing the one or more events;

determine an amount of icing and a rate of ice formation in the one or more refrigeration units based on the identified frosting pattern for each of the one or more refrigeration units;

predict an ice gradient associated with the one or more refrigeration units based on the determined amount of icing and the rate of ice formation;

update a database associated with the server with a set of data packets comprising one or more of the captured parameters, the generated characteristic features, an identified non-systematic events and corresponding predefined threshold values, the identified frosting pattern, the determined amount of icing and rate of ice formation, and the predicted ice gradient; and train, based on the updated database, the server to predict the ice gradient of the one or more refrigeration units in real-time.

2. The system of claim 1, wherein the server is configured to generate and transmit a set of alert signals to the one or more refrigeration units and/or one or more mobile devices based on the predicted ice gradient.

3. The system of claim 1, wherein one or more mobile devices are in communication with the server and/or the one or more refrigeration units.

4. The system of claim 1, wherein the server is configured to:

classify the one or more generated events into a systematic event and the non-systematic event; and identify a frosting pattern associated with the one or more refrigeration units by analyzing the one or more non-systematic events.

5. The system of claim 1, wherein the server is configured with an ancillary injection module to determine unavailable parameters associated with a set of refrigeration units among the one or more refrigeration units based on the available parameters associated with another set of refrigeration units among the one or more refrigeration units.

6. The system of claim 1, wherein the server is configured to identify the frosting pattern from the non-systematic events by normalizing non-systematic events that are not associated with frosting, wherein the identification, normalization, and differentiation of the systematic events and the non-systematic events are achieved by continuous learning during the ice gradient prediction, and wherein the non-systematic events are analyzed based on one or more of a trend, a recent performance, and a variation of the corresponding non-systematic events.

7. The system of claim 1, wherein the server is in communication with a controller associated with the one or more refrigeration units, wherein the controller is configured to:

monitor and store the one or more parameters of the corresponding refrigeration unit.

8. The system of claim 7, wherein when the predicted ice gradient exceeds a threshold value, the server is configured to transmit a set of alert signals to a defrosting unit of the one or more refrigeration units via the controller to enable defrosting of the corresponding refrigeration unit, wherein the threshold value is a dynamic value that is determined and updated by continuously learning during the ice gradient prediction.

9. A device including the system according to claim 1 configurable with one or more refrigeration units and operable to predict ice gradient in the one or more refrigeration units.

10. A method for predicting ice gradient in one or more refrigeration units, the method comprising the steps of:

capturing data pertaining to one or more parameters of the one or more refrigeration units;

correlating the received parameters to generate one or more characteristic features indicative of behaviour and performance of one or more components of the one or more refrigeration units;

generating one or more events based on the generated characteristic features;

identifying a frosting pattern associated with the one or more refrigeration units by analyzing the one or more events;

determining an amount of icing and/or a rate of ice formation in the one or more refrigeration units based on the identified frosting pattern;

predicting ice gradient associated with the one or more refrigeration units based on the determined amount of icing and/or the rate of ice formation; and when the predicted ice gradient exceeds a threshold value, transmitting a set of alert signals to the defrosting unit of the one or more refrigeration units to enable defrosting of the corresponding refrigeration unit, wherein the threshold value is a dynamic value that is determined and updated by continuous learning during the ice gradient prediction.

11. The method of claim 10, wherein the method comprises the step of transmitting a set of control signals to a defrosting unit of the one or more refrigeration units to control defrosting of the corresponding refrigeration unit based on the predicted ice gradient.

12. The method of claim 10, wherein the method comprises the step of determining unavailable parameters associated with a set of refrigeration units among the one or more refrigeration units based on the available parameters captured from another set of refrigeration units among the one or more refrigeration units.

13. The method of claim 10, wherein the method comprises the steps of:

classifying the one or more generated events into a systematic event and a non-systematic event; and identifying a frosting pattern associated with the one or more refrigeration units by analyzing the one or more non-systematic events.

14. The method of claim 13, wherein the method comprises the step of normalizing the identified non-systematic events that are not associated with frosting to identify the frosting pattern from the non-systematic events, and wherein the non-systematic events are analyzed based on a trend, a recent performance, and a variation of the corresponding non-systematic events.

15. The method of claim 10, wherein the one or more parameters comprises:

dynamic parameters comprising one or more of evaporator surface temperature, return air temperature, defrost status, and expansion valve opening degree; and/or static parameters comprising one or more of:

type of controller used in the corresponding refrigeration unit;

attributes comprising type, and cooling type of the one or more refrigeration unit; and/or operational policies associated with the one or more refrigeration units.

16. The method of claim 10, wherein the one or more characteristic features comprise one or more of defrost characteristics, heat exchange characteristics, return air temperature characteristics, and/or expansion valve characteristics.

17. A system to predict ice gradient in one or more refrigeration units, the system comprising:

a server in communication with the one or more refrigeration units, the server comprising a processor coupled to a memory storing instructions executable by the processor and a machine learning module, configured to:

generate one or more characteristic features associated with the one or more refrigeration units based on a correlation of one or more received parameters;

determine an amount of icing and/or a rate of ice formation associated with the one or more refrigeration units based on the generated one or more characteristic features;

predict an ice gradient associated with the one or more refrigeration units based on the determined amount of icing and/or the rate of ice formation;

update a database with a set of data packets associated with the predicted ice gradient; and train, based on the updated database, the server to predict the ice gradient of the one or more refrigeration units in real-time.

* * * * *